United States Patent [19]

Baldwin

[11] Patent Number: 4,513,971

[45] Date of Patent: Apr. 30, 1985

[54] MAZE AND FLEXIBLE WAND GAME APPARATUS

[76] Inventor: David L. Baldwin, 731 NE. 51st Court, Pompano Beach, Fla. 33064

[21] Appl. No.: 606,154

[22] Filed: May 2, 1984

[51] Int. Cl.[3] ..... A63F 9/06

[52] U.S. Cl. ..... 273/153 R; 273/1 GA

[58] Field of Search ..... 273/153 R, 1 R, 1 GA

[56] References Cited

U.S. PATENT DOCUMENTS 3,550,943 12/1970 Hatcher ..... 273/282 X
3,625,516 12/1971 Handweller ..... 273/153 R
4,418,915 12/1983 Calebs ..... 273/159
4,448,413 5/1984 Weindel et al. ..... 273/1 GB

*Primary Examiner*—Anton O. Oechsle
*Attorney, Agent, or Firm*—Oltman and Flynn

[57] ABSTRACT

A game apparatus having flexible and resilent, elongated, player's wands and a game board with side openings for the insertion of the wands. Between the side openings the game board has a labyrinthine maze of interconnected curved passageways connecting the side openings. The maze is formed by several series of circularly arranged vertical rollers and vertical posts in the paths between different series of the rollers. Each wand has a tapered leading end which determines the path it takes through the maze.

18 Claims, 10 Drawing Figures

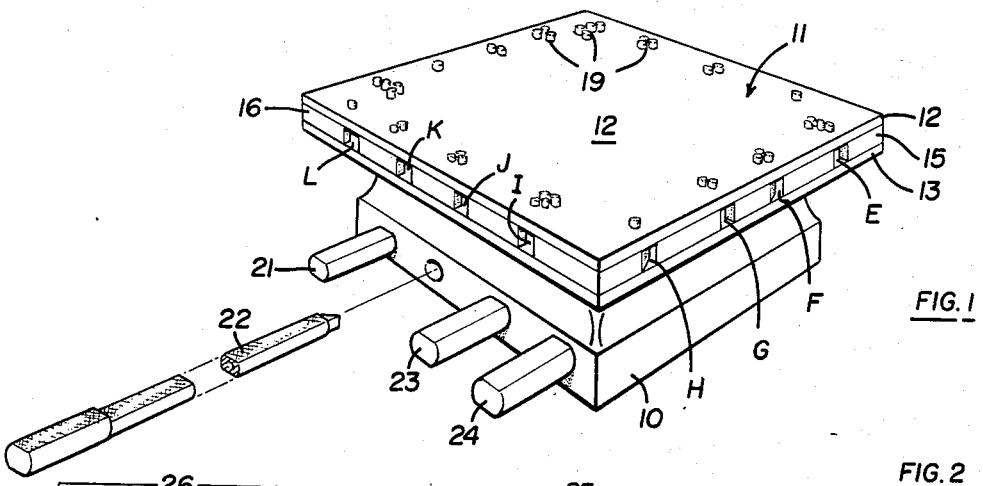
FIG. 1
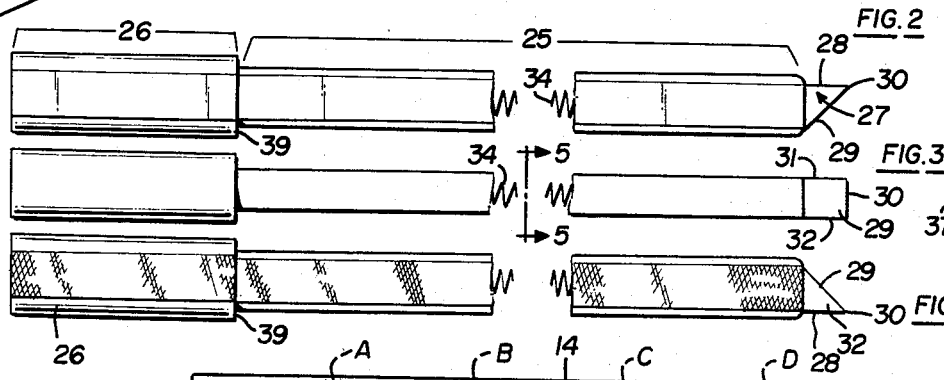
FIG. 2
FIG. 3
FIG. 4
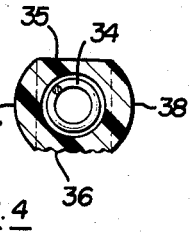
FIG. 5
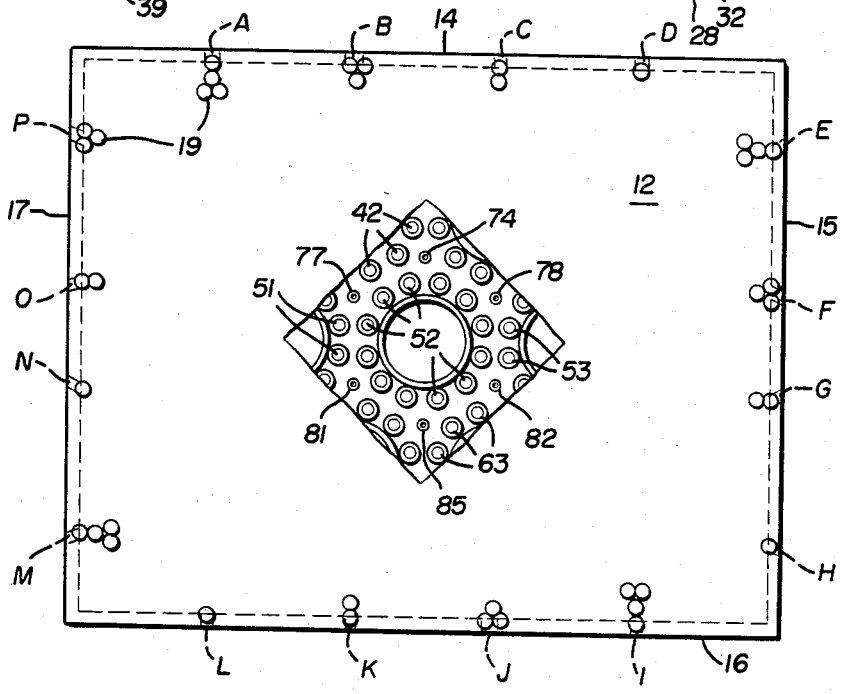
FIG. 6
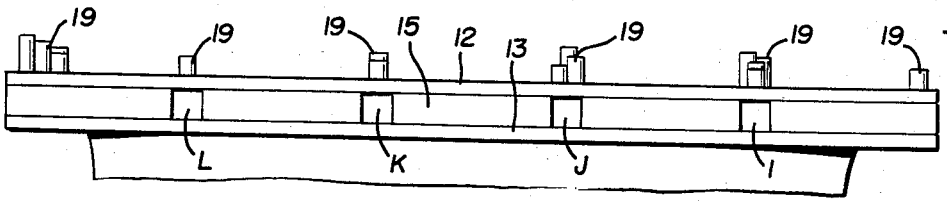
FIG. 7

MAZE AND FLEXIBLE WAND GAME APPARATUS

SUMMARY OF THE INVENTION

This invention relates to a game apparatus having a hollow game board with a labyrinthine maze of interconnected passageways inside and openings leading into and out of this maze, and one or more elongated, flexible and resilient wands to be inserted through one of the openings and pass through the maze and emerge at another opening.

In accordance with the presently preferred embodiment of this invention, the leading end of each wand is tapered on one side. Throughout its passage through the maze, the wand can be rotated to position its tapered leading end face on one side or the other, thereby determining the direction it travels through the maze. Preferably, the maze is formed by several laterally spaced series of circularly arranged vertical rollers for passing the wand in different interconnected curved paths, and vertical rounded posts located centrally in those paths to deflect the leading end of the wand in one direction or the other, depending upon which side of the wand the tapered leading end face is on.

A principal object of this invention is to provide a novel game apparatus which may be played by a single player or by several players competing with each other.

Another object of this invention is to provide such an apparatus in which the object of the game is to manipulate a flexible and resilient wand through a serpentine maze inside a hollow game board from an entry opening to one of several exit openings.

Further objects and advantages of this invention will be apparent from the following detailed description of a presently preferred embodiment which is illustrated schematically in the accompanying drawings.

DESCRIPTION OF THE DRAWINGS

FIG. 1 is a perspective view of the present game aparatus;

FIG. 2 is a top plan view of one of the player's wands;

FIG. 3 is a side elevation of this wand;

FIG. 4 is a bottom plan view of this wand;

FIG. 5 is a cross-section through the wand, taken along the line 5—5 in FIG. 3;

FIG. 6 is a top plan view of the game board with part of its top panel broken open to show the hollow interior;

FIG. 7 is a side elevation of the game board;

Figure 10:
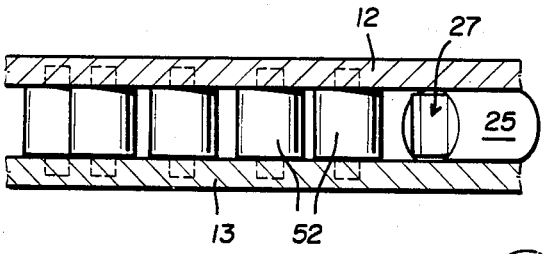
FIG. 10 is an enlarged fragmentary vertical section through the game board showing guide rollers, a post and the tapered leading end of a player's wand.

Before explaining the disclosed embodiment of the present invention in detail it is to be understood that the invention is not limited in its application to the details of the particular arrangement shown, since the invention is capable of other embodiments. Also, the terminology used herein is for the purpose of description and not of limitation.

DETAILED DESCRIPTION

Referring first to FIG. 1, the present amusement apparatus has a base 10 which may rest on a table top or other horizontal support surface (not shown) and an apertured hollow game board 11 on top of the base. The game board has a horizontal, flat, rectangular top panel 12, a horizontal, flat, rectangular bottom panel 13 spaced below and parallel to the top panel, and four vertical sides 14, 15, 16 and 17 (FIG. 8) extending between the top and bottom panels along their side edges. The game board is hollow and presents a serpentine maze of interconnected passageways between its top and bottom panels and its sides, as explained hereinafter.

Figure 8:
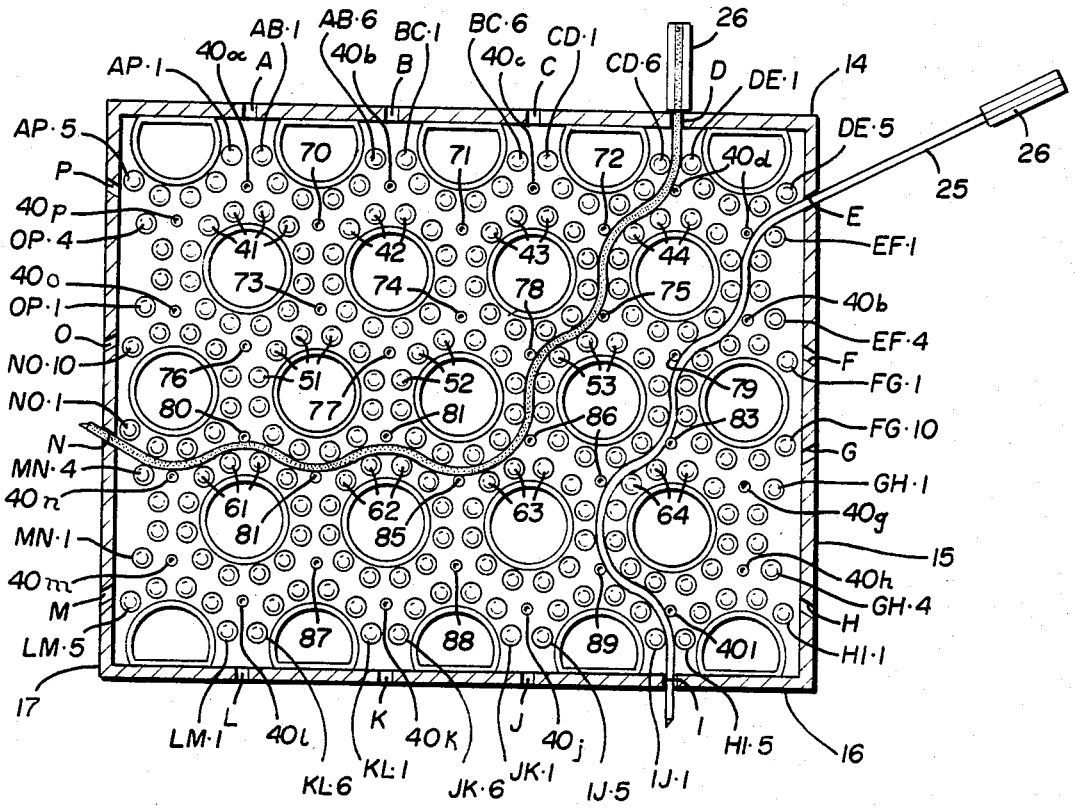
FIG. 8 is a horizontal section looking down into the game board.

Referring to FIG. 8, the first side 14 of the game board is formed with four horizontally spaced openings A,B,C and D leading into its hollow interior. Each of these openings is rectangular, and the axis of each opening extends perpendicular to the plane of the side 14. The opposite side 16 of the game board has similar openings I,J,K and L which, as shown, are directly opposite the openings D,C,B and A, respectively.

The side 15 of the game board has four horizontally spaced openings E,F,G and H, each of which extends horizontally at an acute angle to the plane of this side. Openings E and G are inclined inward toward the game board side 16, whereas openings F and H incline in the opposite direction toward the game board side 14. The fourth side 17 of the game board has four horizontally spaced openings M,N,O and P, which are located directly opposite the opennges H,G,F and E, respectively, and are mirror images of them. Openings M and O incline inward toward the game board side 14, whereas openings N and P incline inward toward the game board side 15.

The top panel 12 of the hollow game board carries visible markers located respectively near the side openings A, B,C,D,E,F,G,H,I,J,K,L,M,N,O and P to give a numerical scoring value for each of these side openings. As shown in FIGS. 1 and 6, these markers are short vertical pegs 19 received in recesses in the top panel. There are four pegs 19 at each of the side openings A,E,I and M, three pegs at each the openings B,F,J and P, two at each of the openings C,G,K and O, and one at each of the openings D,H,L and N. It is to be understood that these are merely illustrative since a side opening can be given any chosen scoring value. Also, if desired, the scoring values may be shown by numbers appearing on the top panel in place of the pegs 19.

The apparatus has four identical, elongated, flexible and resilient wands 21, 22, 23 and 24 which, when not in use, can be stored in corresponding recesses in the base 10, as shown in FIG. 1. These recesses are open at one side of the base to permit the insertion and removal of the wands 21–24.

As shown for the wand 22 in FIGS. 2, 3 and 4, each wand has an elongated flexible and resilient shank segment 25, an enlarged handle segment 26 on one end of the shank segment, and a rigid, tapered tip 27 on the opposite end.

The tip 27 presents a flat side 28 which is a longitudinal continuation or extension of the shank segment 25 when the latter is in its undeformed, straight condition. The tip also presents an opposite flat side 29 which extends at about 45 degrees to the side 28 and intersects the later at a pointed tip 30. Flat, triangular opposite faces 31 and 32 extend perpendicularly between the opposite sides 28 and 29.

The shank segment 25 of each wand has a sheath 33 (FIG. 5) of any suitable flexible material and a coil spring 34 inside the sheath along the entire length of the shank segment. Normally the shank segment is straight but it can bend anywhere along its length against the straightening bias exerted by its spring 34. As shown in FIG. 5, the sheath 33 has opposite, flat, parallel faces 35 and 36 which contrast visually, such as one being dark and the other light, or one being roughened and the other smooth. These contrasting flat faces on the outside of the shank segment 25 are continuations or extensions of the triangular faces 31 and 32 of the beveled tip 27, so that the player knows which side of the tip has the tapered surface 29 by observing which contrasting face 35 or 36 is up. The opposite, contrasting flat faces 35 and 36 are joined by convex side faces 37 and 38 (FIG. 5).

The handle segment 26 is joined in any suitable way to the rear end of the flexible and resilient shank segment. The front end of the handle segment presents a transverse face 39 which, as shown in FIG. 8, limits the extent to which the wand can be inserted into the hollow interior of the game board because it abuts against the outside of the side of the game board around the opening where the wand is inserted. Likewise, this face of the handle limits the insertion of the wand into the corresponding recess in the base 10 where it is stored when not in use as shown in FIG. 1.

Figure 9:
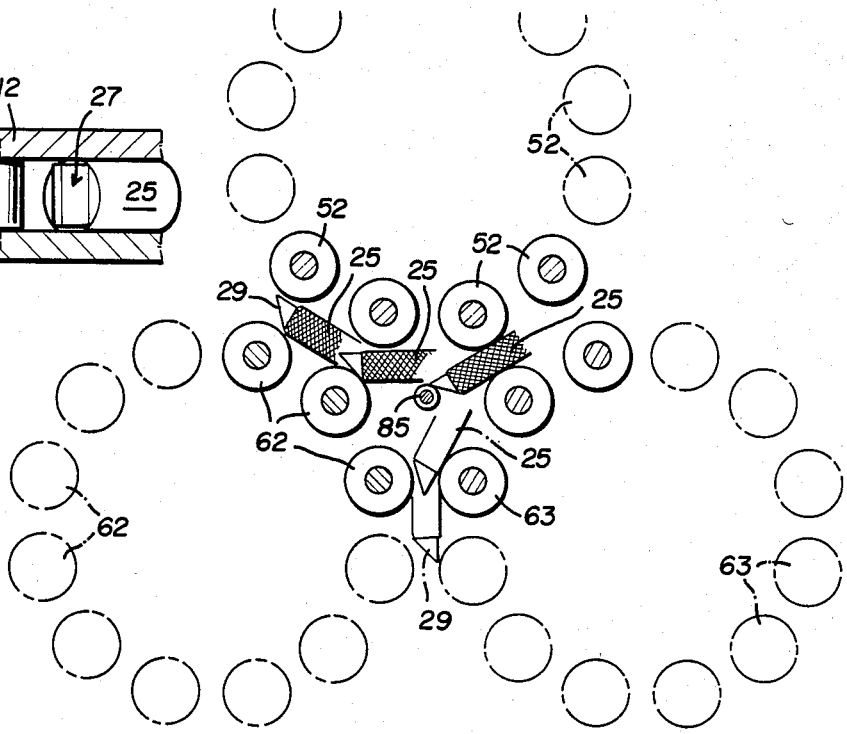
FIG. 9 is an enlarged fragmentary plan view showing rollers and a post forming part of the maze inside the game board, and showing the leading end of a player's wand in full lines deflected by the post in one direction and in phantom deflected by the post in the opposite direction.

As shown in FIG. 8, a vertical cylindrical post **40*a* of circular cross-section is located in the hollow interior of the game board 11 a short distance in from the side opening A and in direct alignment with that opening. Therefore, when a player inserts his or her wand into opening A its beveled tip 27 will strike the post 40*a* and will be deflected to one side or the other depending upon which side of the wand has the tapered tip surface 29, as shown in FIG. 9**.

Similar cylindrical posts **40*b*, 40*c*, 40*d*, 40*e*, 40*f*, 40*g*, 40*h*, 40*i*, 40*j*, 40*k*, 40*l*, 40*m*, 40*n*, 40*o* and 40*p*** are located inward from and in direct alignment with the side openings B, C, D, E, F, G, H, I, J, K, L, M, N, O and P leading into the hollow interior of the game board.

On the left side of the opening A in FIG. 8, a first series of successive vertical guide rollers AP-1, AP-2, AP-3, AP-4 and AP-5 extends through an arc of a circle toward the opening P. The last roller in this series, AP-5, is located between the opening P and the corner between the sides 14 and 17 of the hollow game board. A second series of similar guide rollers AB-1, AB-2, AB-3, AB-4,AB-5 and AB-6 extends in a circular arc from the location of roller AB-1 on the right side of opening A to the location of roller AB-6 on the left side of opening B in FIG. 8. On opposite sides of the opening A, the first rollers AP-1 and AB-1 are close enough to each other to guide the tip 27 of the inserted wand directly toward post **40*a*, so that the direction in which the wand turns when its tip strikes this post is determined by which contrasting flat side 35 or 36 of the wand is up (since this determines which side of the leveled tip 27 the tapered surface 29** is on).

Directly behind each of the posts **40*a*, 40*p* and 40*o* inside the hollow game board is a series of vertical rollers 41** arranged in a circle whose axis is directly aligned with each of the side openings A, P and O in the game board.

Two of the rollers 41 are close enough to the rollers AB-2 and AB-3 to guide the tip 27 of an inserted wand between these sets of rollers after it has been deflected to the right in FIG. 8 by post **40*a*. The tapered end face 29 of the wand tip will slide across the roller 41 which is closest to roller AB-2** to guide the wand into the path between these series of rollers.

Two other rollers 41 are close enough to the rollers AP-2 and AP-3 to guide the tip of the wand between these two sets of rollers after it has been deflected to the left in FIG. 8 by post **40*a*. The tapered end face 29 of the wand tip will slide across the roller 41 which is closest to roller AP-2** to guide the leading end of the wand into the path between these series of rollers.

On the right side of the opening B in FIG. 8, another series of vertical guide rollers BC-1 through BC-6 extends through an arc of a circle toward the next side opening C. The last roller BC-6 in this series is located on the left side of the opening C. The first roller BC-1 in this series is close enough to the roller AB-6 on the opposite side of opening B to guide the tip 27 of a wand which is inserted in this opening directly toward the post **40*b***.

Directly behind post **40*b* is a series of vertical rollers 42 arranged in a circle whose axis is directly aligned with the side opening B and directly aligned with the circular axis of the series of rollers 41. Two of the rollers 42 are close enough to rollers AB-4 and AB-5, respectively, to guide the tapered tip 27 of an inserted wand between these two series of rollers after it is deflected to the left by post 40*b*. Another two of the rollers 42 are close enough to two of the roller 41 to guide the tip of an inserted wand between the two series of rollers 42 and 41. Another two of the rollers 42 are close enough to rollers BC-2 and BC-3 to guide the wand between these two series of rollers after it is deflected to the right by post 40*b***.

A vertical cylindrical post 70 is located centrally among the three neighboring sets of rollers AB-1 through AB-6, 41 and 42. A wand which has been inserted in side opening A and deflected to the right (in FIG. 6) by post **40*a* will pass directly toward post 70 between rollers AB-2 and AB-3 on one side and rollers 41 on the opposite side. If post 70 deflects the wand to the left, it will pass between rollers 41 on one side and rollers 42 on the opposite side. If post 70 deflects the wand to the right, it will pass directly toward post 40*b* between rollers AB-4 and -AB-5 on one side and rollers 42** on the opposite side.

This same pattern of circularly arranged series of rollers and posts located centrally in the paths among these circular series of rollers is repeated throughout the hollow interior of the game board. The rollers include, along the sides of the hollow game board:

an arcuately arranged series of rollers CD-1 through CD-6 between the side openngs C and D;

an arcuate series of rollers DE-1 through DE-5 between the side openings D and E;

an arcuate series of rollers EF-1 through EF-4 between the side openings E and F;

an arcuate series of rollers FG-1 through FG-10 between side openings F and G;

an arcuate series of rollers GH-1 through GH-4 between side openings G and H;

an arcuate series of rollers HI-1 through HI-5 between side openings H and I;

an arcuate series of rollers IJ-1 through IJ-6 between side openings I and J;

an arcuate series of rollers JK-1 through JK-6 between side openings J and K;

an arcuate series of rollers KL-1 through KL-6 between side openings K and L;

an arcuate series of rollers LM-1 through LM-5 between side openings L and M;

an arcuate series of rollers MN-1 through MN-4 between side openings M and N;

an arcuate series of rollers NO-1 through NO-10 between side openings N and O; and an arcuate series of rollers OP-1 through OP-4 between side openings O and P.

The rollers inside the hollow game board also include, in the same row as the roller series 41 and 42 (running parallel to the side 14 of the game board):

a circular series of rollers 43 behind post 40*c* and having its circular axis aligned with those of the respective series of rollers 41 and 42;

and a circular series of rollers 44 behind posts 40*d*. 40*e* and 40*f* and having its circular axis aligned with those of the respective series of rollers 41, 42 and 43.

The rollers inside the hollow game boad also include, in a row located midway between the opposite sides 14 and 16 of the game board and running parallel to those sides:

a circular series of rollers 51 located behind and midway between the rollers series 41 and 42, and having its circular axis aligned with the axis of the arcuate series of rollers NO-1 through NO-10;

a circular series of rollers 52 located behind and midway between the roller series 42 and 43, and having its circular axis aligned with that of the circular roller series 51 and the arcuate roller series NO-1 through NO-10;

and a circular series of rollers 53 located behind and midway between the roller series 43 and 44, and having its circular axis aligned with those of the roller series 51, 52 and NO-1 through NO-10.

Finally, the rollers inside the game board include a row of rollers located between the middle row 51, 52, 53 and the side 16 of the game board. This row of rollers includes:

a circular series of rollers 61 located the same distance inward from the side 17 as rollers 41;

a circular series of rollers 62 located the same distance inward from the side 17 as rollers 42;

a circular series of rollers 63 located the same distance inward from the side 15 as rollers 43;

and a circular series of rollers 64 located the same distance inward from the side 15 as rollers 44.

The following vertical cylindrical posts are located inside the game board midway among different series of rollers, as follows:

post 71 midway among roller series 42, 43 and BC-1 through BC-6;

post 72 midway among roller series 43, 44 and CD-1 through CD-6;

post 73 midway among roller series 41, 42 and 51;

post 74 midway among roller series 42, 43 and 52;

post 75 midway among roller series 43, 44 and 53;

post 76 midway among roller series 41, 51 and NO-1 through NO-10;

post 77 midway among roller series 42, 51 and 52;

post 78 mkdway among roller series 43, 52 and 53;

post 79 midway among roller series 44, 53 and FG-1 through FG-10;

post 80 midway among roller series 51, 61 and NO-1 through NO-10;

post 81 midway among roller series 51, 52 and 62;

post 82 midway among roller series 52, 53 and 63;

post 83 midway among roller series 53, 64 and FG-1 through FG-10;

post 84 midway among roller series 51, 61 and 62;

post 85 midway among roller series 52, 62 and 63;

post 86 midway among roller series 53, 63 and 64;

post 87 midway among roller series 61, 62 and KL-1 through KL-6;

post 88 midway among roller series 62, 63 and JK-1 through JK-6;

and post 89 midway among roller series 63, 64 and IJ-1 through IJ-6.

With this arrangement, it will be evident that when a player inserts his playing wand into a selected side opening A,B,C, etc., the tapered tip 27 first will engage the post numbered "40" and having the letter suffix which is the same as the letter of that side opening (e.g., post 40*a* for side opening A, post 40*p* for side opening P). The wand will turn to one side or the other of this first post and will pass between two series of circularly arranged rollers to the next post along its path into the hollow game board 11. For example, if, as shown in FIG. 8, a playing wand inserted into the side opening D is deflected to the left by the first post 40*d*, it will pass between two rollers 44 and rollers CD-5 and CD-4 to post 72.

If now the player wants the leading end of the wand to turn to the right in FIG. 8 (which would be to the left, viewed from the player's position), the player will rotate the wand (about its own longitudinal axis) to reverse the position of its tapered tip 27 before it engages post 72. Assuming that the player has done this, the leading end of the wand is deflected to the right in FIG. 8 by post 72 and its passes between closely spaced rollers 43 and 44 to post 75.

If the player wants the leading end of the wand to turn to the left in FIG. 8 at post 75, he again rotates the wand one-half turn to reverse the position of the tapered tip 27 of the wand before it engages this post. Therefore, the leading end of the wand is deflected to the left by post 75 and it passes between closely spaced rollers 43 and 53 to post 78.

If the player wants the wand to turn to the right in FIG. 8 at post 78, he turns the wand one-half turn to reverse the position of the tapered tip 27 of the wand before it engages this post. The leading end of the wand is deflected to the right by post 78 and it passes between closely spaced rollers 52 and 53 to post 86.

If the player wants the wand to turn to the left in FIG. 8 at post 86, he turns the wand one-half turn before it engages this post. At post 86 the leading end of the wand is deflected to the left and it passes between closely spaced rollers 52 and 63 to post 85.

If the player wants the wand to pass above post 85 in FIG. 8, he keeps the wand in the same rotational position. The leading end of the wand is deflected by post 85 and it passes between closely spaced rollers 52 and 62 to post 81. This is shown in enlarged detail in full lines in FIG. 9. The phantom-line Figure shows the direction the wand would take if the player turns the wand one-half turn just before it engages post 85.

If the player wants the wand to pass under post 81 in FIG. 8, he turns the wand one-half turn before it engages this post. The leading end of the wand is deflected by post 81 and it passes between closely spaced rollers 51 and 62 to post 84.

If the player wants the wand to turn to pass above post 84 in FIG. 8, he turns the wand one-half turn before it engages this post. The leading end of the wand is deflected by post 84 and it passes between closely spaced rollers 51 and 61 to post 80.

If the player wants the wand to pass below post 80 in FIG. 8, he turns the wand one-half turn before it engages this post. The leading end of the wand is deflected by post 80 and it passes between closely spaced rollers 61 and NO-4 and NO-3 to post 40*n*.

If the player wants the leading end of the wand to come out of the side opening N, he turns the wand one-half turn before it engages post 40*n*. The leading end of the wand passes above post 40*n* in FIG. 8 and it passes between closely spaced rollers MN-4 and NO-2 to the side opening N.

FIG. 8 also shows a second player's wand which has been inserted into the game board at the side opening E and has been manipulated by that player to emerge at the side opening I.

The various posts and rollers inside the game board constitute abutments which define a serpentine maze of interconnected curved passageways extending between the side openings A through P.

It will be apparent that the choices made by the player as to when to rotate his wand one-half turn, and when not to, determine the path of his wand through the maze inside the hollow game board 11. In addition, with more than one player playing at the same time, each player must manipulate his wand so as not to have its path blocked by another player's wand, which he cannot see, inside the hollow game board. Each player's score can be determined solely by the numerical value assigned to the side opening where his wand emerges, or by a combination of this numerical value and the time it takes him to get it there from the side opening where he inserted his wand.

I claim:

1. A game apparatus comprising:

a game board having a hollow interior and openings leading into its hollow interior, means providing abutments inside said game board defining a maze of passageways which communicate with said openings;

and an elongated flexible and resilient wand which is insertable through a selected one of said openings into said hollow interior of the game board to emerge at another of said openings, depending upon how a player manipulates the wand;

said wand having a leading end which is tapered on one side to determine the direction in which the wand is deflected by abutments it engages in said maze of passageways.

2. A game apparatus according to claim 1, wherein said wand is rotatably adjustable while in said maze of passageways to selectively determine the position of its tapered leading end.

3. A game apparatus according to claim 2 wherein said wand has visually different opposite longitudinal faces which indicate the direction of the taper on its leading end.

4. A game apparatus according to claim 1, wherein said game board has spaced top and bottom faces and sides extending between said top and bottom faces and having said openings therein.

5. A game apparatus according to claim 4, wherein said wand has a leading end which is tapered on one side to determine the direction in which the wand is deflected by abutments it engages in said maze of passageways.

6. A game apparatus according to claim 5, wherein said wand is rotatably adjustable while in said maze of passageways to selectively determine the position of its tapered leading end.

7. A game apparatus according to claim 6, wherein said wand has visually different opposite longitudinal faces which indicate the direction of the taper on its leading end.

8. A game apparatus according to claim 4, wherein said means providing abutments inside said game board comprises:

a plurality of different series of rounded guide members having the guide membes of each series arranged in succession along a curved path and spaced from the guide members of the other series to form different interconnected paths for the wand;

and a plurality of rounded posts located centrally in said different paths among the different series of guide members to deflect the leading end of the wand.

9. A game apparatus according to claim 8, wherein said rounded guide members are rollers rotatably mounted inside said game board.

10. A game apparatus according to claim 9, wherein said posts include respective posts located close to said openings and each directly aligned with the path of the leading end of the wand inserted into the corresponding opening.

11. A game apparatus according to claim 10 wherein:

certain of said openings extend perpendicular to the respective sides of the game board;

and others of said openings extend at different oblique angles to the respective sides of the game board.

12. A game apparatus according to claim 8 wherein:

certain of said openings extend perpendicular to the respective sides of the game board;

and others of said openings extend oblique to the respective sides of the board board.

13. A game apparatus according to claim 1, wherein said means providing abutments inside said game board comprises:

a plurality of different series of rounded guide members having the guide members of each series arranged in succession along a curved path and spaced from the guide members of the other series to form different interconnected paths for the wand;

and a plurality of rounded posts located centrally in said different paths among the different series of guide members to deflect the leading end of the wand.

14. A game apparatus according to claim 13, wherein said rounded guide members are rollers rotatably mounted inside said game board.

15. A game apparatus according to claim 14, wherein said posts include respective posts located close to said openings and each directly aligned with the path of the leading end of the wand inserted into the corresponding opening.

16. A game apparatus comprising:

a polygonal game board having vertically spaced top and bottom panels and sides extending between said top and bottom panels, said game board having a hollow interior and having openings in its sides leading into its hollow interior;

a plurality of different series of rounded guide members extending vertically between said top and bottom panels inside the hollow interior of the game board, with the guide members of each series arranged in succession along a curved path and spaced laterally from the guide members of the other series to form a maze of different interconnected paths through the interior of the game board between different openings in said sides of the game board;

a plurality of rounded vertical posts located centrally in said different paths among the different series of guide members;

and an elongated flexible and resilient wand which is insertable through a selected one of said openings in the sides of the game board into said hollow interior of the game board and is slidable along said paths between the different series of guide members, said wand having a pointed leading end which is tapered on one side for engagement with said posts to be deflected by each post it engages.

17. A game apparatus according to claim 16, wherein said wand is rotatably adjustable after insertion in the game board to selectively determine the position of its tapered leading end and has visually different opposite longitudinal faces which indicate the direction of the taper on its leading end.

18. A game apparatus according to claim 17, wherein:

said guide members are rollers rotatably mounted inside the game board;

said posts are substantially cylindrical;

and said posts include respective posts located closely inward from said openings in the sides of the game board and each directly aligned with the path of the leading end of the wand inserted into the corresponding opening.

* * * * *